United States Patent [19]

Marra et al.

[11] 4,406,723

[45] Sep. 27, 1983

[54] FABRIC REPAIRING METHOD

[75] Inventors: Michael Marra, Huntington; Thomas J. Pendleton, North Wilton, both of Conn.; Douglas W. Smith, Oakland; Artin G. Vartoukian, Roselle Park, both of N.J.

[73] Assignee: The Singer Company, Stamford, Conn.

[21] Appl. No.: 372,497

[22] Filed: Apr. 28, 1982

[51] Int. Cl.[3] ..... B32B 35/00

[52] U.S. Cl. ..... 156/98; 83/20; 83/176; 156/211; 156/227; 156/250; 428/63

[58] Field of Search ..... 83/17, 20, 176, 861; 156/98, 268, 211, 227, 250; 428/63

[56] References Cited

U.S. PATENT DOCUMENTS

| | | | |
|---|---|---|---|
| 138,357 | 4/1973 | Allen . | |
| 1,113,030 | 10/1914 | McLaurin . | |
| 2,649,876 | 8/1953 | Thompson et al. . | |
| 3,271,217 | 9/1966 | Mapson | 156/98 |
| 3,513,048 | 5/1970 | Snyder | 156/98 |
| 3,772,114 | 11/1973 | Kowalchuk | 156/98 |
| 4,047,300 | 9/1977 | Sweeney, Jr. | 30/358 |
| 4,358,335 | 11/1982 | Reinert | 156/98 X |

*Primary Examiner*—Robert A. Dawson

*Attorney, Agent, or Firm*—William V. Ebs; Robert E. Smith; Edward L. Bell

[57] ABSTRACT

A damaged area of a fabric is repaired by removing the damaged area from the fabric while folded across the damaged site, and thereafter bonding a patch and underlying thermoplastic impregnated pad to each other and to the fabric with the application of heat.

10 Claims, 7 Drawing Figures

FABRIC REPAIRING METHOD

BACKGROUND OF THE INVENTION

1. Field of the Invention

The invention relates to methods for repairing a damaged area of a fabric with a patch taken from fabric which is like the damaged material.

2. Description of the Prior Art

It is well known to repair a damaged garment by first punching a hole in the fabric at the damaged site of sufficient size to include all of the damaged area, and to then punch out a patch identical in size and shape to such hole for use in making the repair from fabric which is the same as the damaged fabric. The patch is preferably obtained from an unnoticable part of the damaged fabric to assure a match at the damaged site. A support pad impregnated with a thermoplastic adhesive is placed under the hole, and the patch is placed in the hole, after which heat is applied to the patch to melt the thermoplastic adhesive and cause it to flow into the interstices of adjacent portions of the fabric and patch to complete the repair. Fabric repairing methods of the kind described are disclosed, for example, in U.S. Pat. No. 3,271,217, for "Method of Mending Holes in Fabrics" of D. L. Mapson, issued Sept. 6, 1966, in U.S. Pat. No. 3,513,048, for "Method of Making a Patch Structure for Fabrics" of B. L. Synder issued May 19, 1970, and in copending patent application of The Singer Company for "Fabric Repairing Assembly" of Gerhard Reinert, Ser. No. 284,877, filed July 20, 1981 and now U.S. Pat. No. 4,358,335.

In general, such methods have proved unsatisfactory for repairing a lined garment since they do not include a procedure enabling a damaged area or a patch to be conveniently removed from the garment without damage to the lining. The damaged area and patch would be removed from the garment with an impact punch, or cutting tool, the operation of which necessitated also punching or cutting a hole in the lining unless it was first ripped away from inside the garment.

It is a prime object of the present invention to provide an improved method for repairing a fabric permitting a damaged area and patch to be conveniently removed from a lined garment without damage to the lining.

It is another object of the invention to provide an improved method for individually removing a damaged area and patch from a garment during a repairing procedure in a one-shot shearing operation.

Other objects and advantages of the invention will become apparent during a reading of the specification taken in connection with the accompanying drawings.

SUMMARY OF THE INVENTION

In accordance with the invention, a damaged garment or other article is repaired by folding the fabric of the article so as to include the damaged area in layers of the fold. In a lined garment, the lining is pinched away from the fabric with the fingers so as not to be included in the fold. A portion of the fabric including the damaged area is removed from the folded layers as in a one-shot shearing operation. A patch corresponding in size and configuration to the hole left in the garment by removal of the damaged area is then similarly removed from a folded inconspicuous part of the same fabric or from a like piece of material. A thermoplastic adhesive pad is placed in overlapping relationship with said hole on the normally unexposed side of the damaged fabric.

The patch is disposed in the hole and is bonded to the pad and surrounding fabric with the application of heat.

DESCRIPTION OF THE INVENTION

Figure 1:
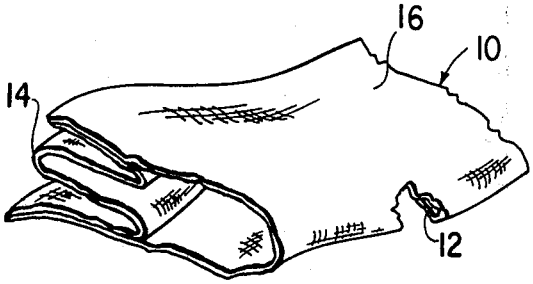
FIG. 1 is a perspective view showing a piece of damaged fabric with the lining therefor separated from the fabric.
Figure 2:
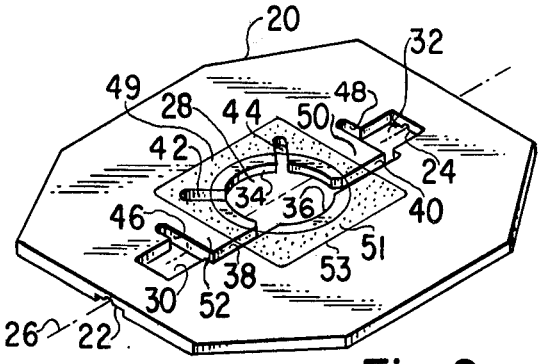
FIG. 2 is an inside perspective view of a fabric clamp for use in carrying out the method of the invention.

Referring to the drawings, reference character 10 designates a piece of fabric in which there is nondescript hole 12 requiring repair. A lining 14 is shown separated from the damaged area defined by the hole 12. The fabric piece 10 and lining 14 may, for example, be considered part of garment such as a suit, skirt or other piece of wearing apparel.

In order to effect a repair in such a garment in accordance with the invention, it is necessary to remove a portion of the fabric which includes the damaged area from the garment. This is accomplished with any lining such as the lining 14 pulled back from the damaged area, and with the fabric folded directly through the damaged area or close thereto into overlying layers 16 and 18.

In preparation for the removal of the damaged area, the fabric is preferably folded with and secured in a plastic clamp 20 of the kind disclosed in the patent application of Michael Laude et al. for "Fabric Shearing and Heating Tool" Ser. No. 372,496, filed concurrently herewith. As shown, clamp 20 is formed on one side with aligned grooves 22 and 24 which are scored at 23 and 25 to define a fold line 26 for the clamp extending centrally between the grooves, and through a central opening 28 in the clamp as well as through rectangular openings 30 and 32 provided therein. Opening 28 includes perimetal edge portions defined by circular arcs 34 and 36 having different radii, but having a common center on the fold line 26. Circular arc 34 having the greater radius extends beyond a semicircle to slits 38 and 40. Circular arc 36 with the smaller radius also extends to slits 38 and 40 as shown. The slits 38 and 40 communicate with the rectangular openings 30 and 32 which extend to the grooved portions 22 and 24, respectively of the clamp. The slits 42, 44, 46 and 48 render portions 50 and 52 of the clamp bracketing the opening 28 slightly spreadable.

Before the clamp is used to fold the fabric, inside areas 49 and 51 thereon are rendered sticky to the fabric as with an applied facing 53 having an adhesive coating on each of the opposite sides thereof. Fabric piece 10 may then be disposed on clamp 20. The fabric piece is positioned so as to locate the edge of hole 12 and a margin of surrounding fabric within opening 28. The clamp includes grid lines 54 and 56, and if the fabric is patterned, the pattern is also located in a recallable manner with respect to such grid lines. Once the fabric piece has been suitably positioned, the lining is pinched back by the user as the clamp is folded to bring fabric layers 16 and 18 into a contiguous relationship.

After the fabric piece has been folded, the overlying contiguous layers of fabric in the clamp may be cut as in a shearing operation to remove the damaged area and a surrounding margin of fabric. The fabric is preferably sheared rather than punched out because a cleaner cut is more readily obtainable in multiple layers of fabric in a shearing operation, especially when the fabric is of a substantial thickness. The damaged area and surrounding margin of fabric are best removed from a fabric piece 12 with a cutting tool 62 of the kind disclosed in the aforementioned patent application Ser. No. 372,496. Such tool includes a cylindrical cutter 64 with a sharp cutting edge 66 in an oblique plane. The cutter is slidable in the cylindrical bore 68 of a member 70 which is affixed in the housing 72 of the tool. The radius of the bore 68 substantially corresponds to the radius of circular arc 36. Member 70 and housing 72 include aligned transverse slots 74 and 76. The folded clamp with fabric therein may be located in slots 74 and 76 with the perimetal edge of opening 28 along arc 34 in engagement with an outer cylindrical surface 78 on member 70 projecting into slot 76, with the ends 80 and 82 of clamp portions 50 and 52 at the bottom of a slot 84 in the housing 72 of the tool, with outer surface 85 of the clamp against the housing at the end of slot 76 and with outer surface 86 of the clamp engaged by a spring 88 which is provided to maintain the clamp in a closed condition. When the clamp has been located as described the perimetal edge of the clamp along arc 36 is aligned with cylindrical bore 68 and the clamp cannot move in the slots 74 and 76.

With the clamp suitably located in tool 62, the cutter may be caused to move down bore 68 as described in the aforesaid patent application Ser. No. 372,496 and cut through the folded layers of fabric in a one shot operation. Following the cutting operation, the clamp is removed from the tool and unfolded to permit removal of the fabric piece 12 which then has a clean cut circular hole 90 requiring repair rather than the nondescript hole 12. The diameter of such hole will substantially correspond to the diameter of the cutter 64.

Figure 4:
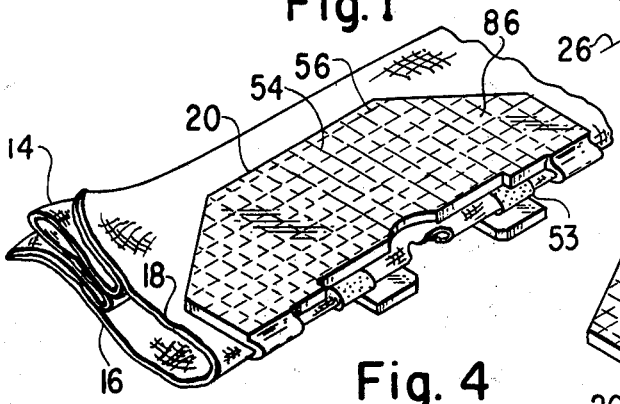
FIG. 4 is a perspective view showing the damaged fabric in the clamp.
Figure 3:
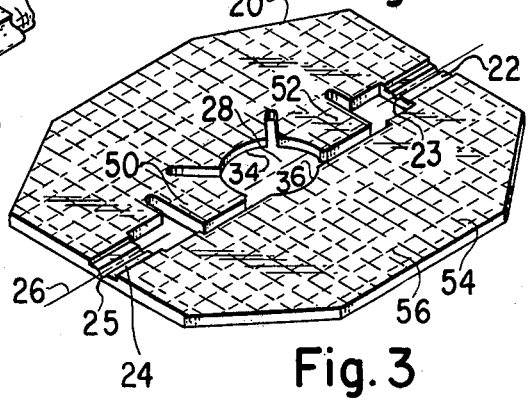
FIG. 3 is an outside perspective view of the clamp.
Figure 5:
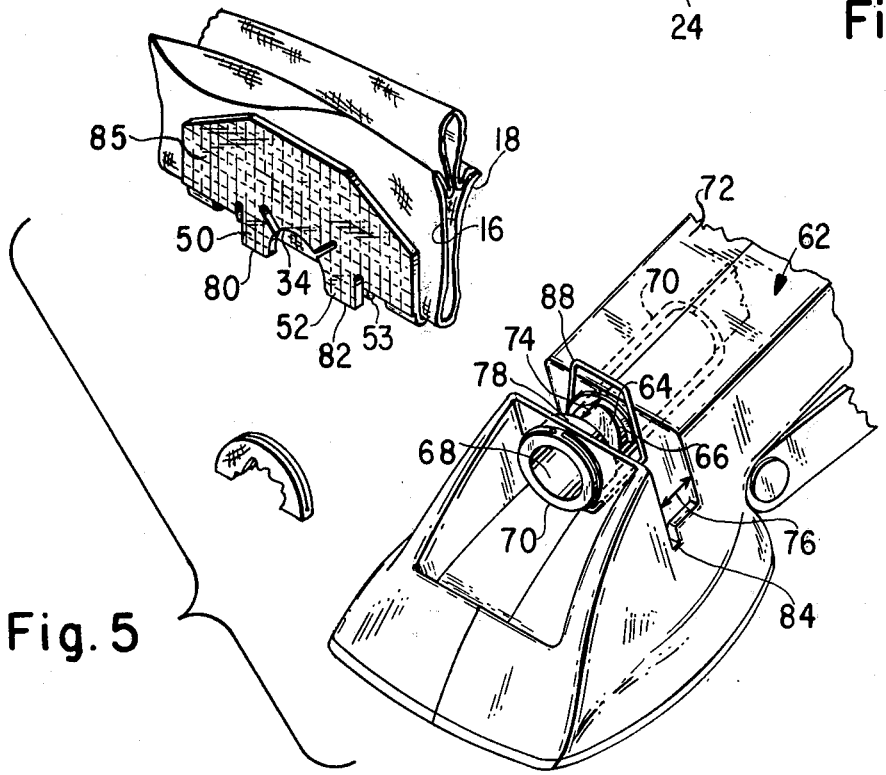
FIG. 5 is a fragmentary perspective somewhat diagrammatic view showing apparatus for cutting a hole by means of a one shot shearing operation in the fabric held by the clamp.

A patch 92 is obtained for hole 90 by removing a disc of fabric substantially equal in diameter to the diameter of the hole from an inconspicuous part, such as a cuff, hem or internal seam of the damaged garment, or by removing such a disc of fabric from some other like piece of material. A patch of the proper size and configuration is best obtained with the aid of clamp 20 and the fabric cutting mechanism of FIG. 4, that is, by folding a portion of the fabric from which the patch is to be obtained with the clamp while pinching back any lining, locating the clamp in slots 74 and 76, and causing the cutter 64 to cut out the patch from the fabric folds. As previously indicated, when a damaged portion of a patterned fabric is located in clamp 20 the pattern is positioned with respect to grid lines 54 and 56. By similarly locating the patterned fabric for the patch with respect to such grid lines in the clamp a patch may be obtained, which when suitably positioned in hole 90, will continue the pattern of the surrounding area.

Figure 6:
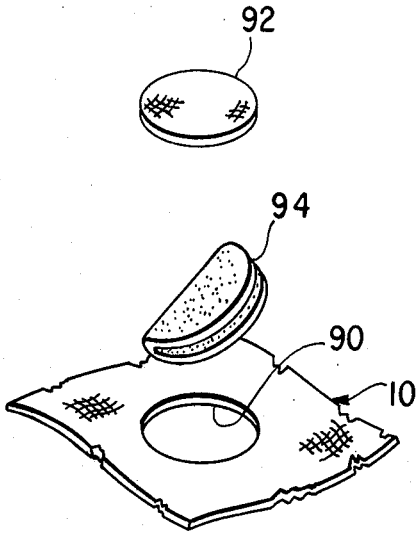
FIG. 6 is a perspective view showing the fabric with a hole formed therein, a thermoplastic pad for insertion through the hole, and a formed patch for the hole.
Figure 7:
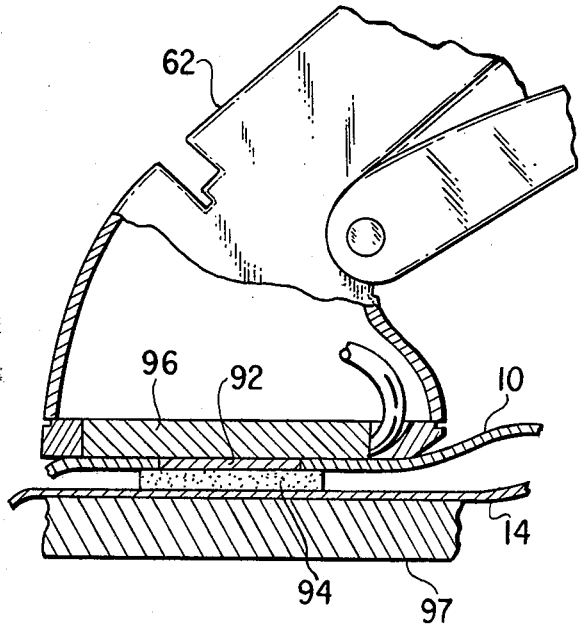
FIG. 7 is a vertical sectional view indicating the application of said patch to the damaged fabric.

Patch 92 may be conveniently applied to fabric piece 10 in the manner shown in FIGS. 6 and 7. A pad 94, impregnated with a thermoplastic adhesive and somewhat larger than the hole 90, is first folded, and is then inserted through the hole to the normally unexposed side of the fabric piece where the pad is permitted to unfold. The fabric piece is then slightly manipulated as with the aid of a central top locator mark on the pad into a position wherein the mark is centrally located in the hole and the pad completely overlaps the hole on the underside of the fabric. Patch 92 is positioned in the hole 90 and a heated platten 96 in tool 62 is pressed down upon the fabric piece 10 over the patch while the thermoplastic pad 94 is supported as through lining 14 on a table 97. Heat from the platten melts thermoplastic adhesive in the pad 94 and causes the adhesive to flow into the interstices of adjacent portions of the fabric piece 10 to complete a repair. The platten 96 is controlled as described in the aforesaid patent application, Ser. No. 372,496 to a temperature which while sufficient to melt the adhesive in the upper portion of the pad as required to bond the pad to the patch 92 and fabric piece 10, is not so high as to permit the adhesive in the lower portion to melt and cause the pad to adhere to a lining 14, or to damage the fabric.

It is to be understood that the present disclosure relates to a preferred embodiment of the invention which is for purposes of illustration only, and is not to be construed as a limitation of the invention. Numerous alterations and modifications of the method herein disclosed will suggest themselves to those skilled in the art, and all such modifications which do not depart from the spirit and scope of the invention are intended to be included within the scope of the appended claims.

We claim:

1. A method of repairing damage to fabric which comprises folding a portion of the fabric including the damaged area into overlying layers extending to a folded edge, removing from the folded layers a piece of the fabric including the damaged area and extending around said folded edge, unfolding said fabric, removing from an inconspicuous part of the same fabric or from a like piece of material a patch substantially corresponding in size and configuration to the hole left by removal from the folded layers of the said fabric piece including the damaged area, placing a pad impregnated with a thermoplastic adhesive in overlapping relationship with the said hole on the normally unexposed side of the damaged fabric, disposing said patch in the hole and bonding the patch to the pad and surrounding fabric with the application of heat.

2. A method of repairing damage to fabric according to claim 1 wherein the fabric is folded through the damaged area.

3. A method of repairing damage to fabric according to claim 1 wherein the heat is applied at a controlled temperature limiting the melting of adhesive to a defined region in the pad adjacent the patch and said fabric.

4. A method of repairing damage to fabric according to claim 1 wherein a disc shaped piece of the fabric including said damaged area is removed from the folded layers.

5. A method of repairing damage to fabric according to claim 1 wherein the patch is removed from an inconspicuous part of a folded portion of the same fabric or from a folded part of a like piece of material.

6. A method of repairing damage to fabric according to claim 5 wherein the piece of fabric including the damaged area, and the said patch are each removed in a one shot shearing operation.

7. A method of repairing damage to a lined fabric including the method steps of claim 1 and an additional step in which the lining is pulled back from the damaged area before the fabric is folded.

8. A method of repairing damage to a fabric according to claim 1 which includes securing the folded layers of fabric in a clamp, affixing the clamp in a cutting tool, and removing the said portion of the fabric including the damaged area from the folded layers with the cutting tool.

9. A method of repairing damage to a fabric according to claim 8 which includes securing the folded layers of the material from which the patch is obtained in said clamp, affixing the clamp in the tool a second time and removing the patch from such folded layers of material with the cutting tool.

10. A method of repairing damage to a patterned fabric with a similarly patterned material including the method steps of claim 9 and further including correspondingly locating the pattern of said patterned fabric and the pattern of said patterned material in the clamp.

* * * * *